US006164806A

United States Patent [19]

Schmickl et al.

[11] Patent Number: 6,164,806

[45] Date of Patent: Dec. 26, 2000

[54] LIGHTING DEVICE FOR A MOTOR VEHICLE

[75] Inventors: Klaus Schmickl; Bernhard Maurer, both of Reutlingen; Dietmar Schoenettin, Leinfelden, all of Germany

[73] Assignee: Robert Bosch GmbH, Stuttgart, Germany

[21] Appl. No.: 09/214,770

[22] PCT Filed: Mar. 10, 1998

[86] PCT No.: PCT/DE98/00699

§ 371 Date: Jan. 12, 1999

§ 102(e) Date: Jan. 12, 1999

[87] PCT Pub. No.: WO98/59197

PCT Pub. Date: Dec. 30, 1998

[30] Foreign Application Priority Data

Jun. 20, 1997 [DE] Germany ..... 197 26 328

[51] Int. Cl.[7] ..... F21V 29/00

[52] U.S. Cl. ..... 362/547; 362/294; 362/373

[58] Field of Search ..... 362/294, 345, 362/373, 547

[56] References Cited

U.S. PATENT DOCUMENTS

| | | | |
|---|---|---|---|
| 4,405,974 | 9/1983 | Quiogue | 362/294 |
| 4,612,607 | 9/1986 | Segoshi et al. | 362/345 |
| 4,796,163 | 1/1989 | Dressler | 362/294 |
| 4,802,068 | 1/1989 | Mokry | 362/294 |
| 5,406,467 | 4/1995 | Hashemi | 362/294 |
| 5,497,308 | 3/1996 | Ohtsuka et al. | 362/294 |
| 5,758,957 | 6/1998 | Perrotin | 362/294 |

FOREIGN PATENT DOCUMENTS 35 42 457 A1 6/1987 Germany .

*Primary Examiner*—Alan Cariaso
*Attorney, Agent, or Firm*—Michael J. Striker

[57] ABSTRACT

A lighting device has a sealed interior, which communicates with the environment via an upper vent opening and another lower vent opening. The upper vent opening is covered with a mat-like insert, which is air-permeable and water-repellant. The upper vent opening is formed in a wall that points downward. To protect the upper vent opening against splashing water, a shielding device is provided. Communicating with the lower vent opening is a line that discharges on the underside of the vehicle. When the vehicle is in motion, a pressure difference is developed between the upper vent opening and the lower vent opening, so that there is a flow through the interior from top to bottom. The insert prevents dirt and water from the road from entering the interior.

12 Claims, 2 Drawing Sheets

LIGHTING DEVICE FOR A MOTOR VEHICLE

BACKGROUND OF THE INVENTION

The invention is based on a lighting device for vehicles as generically defined by the preamble to claim 1.

One such lighting device is known from German Patent Disclosure DE 35 42 547 A1. This lighting device, in the form of a headlight, has a sealed interior in which at least one reflector with at least one light source is disposed. The interior communicates with the environment via at least one vent opening in a portion of the lighting device that defines the interior. A drying agent, by which moisture is to be extracted from the air flowing into the interior, is disposed in the region of the vent opening. The drying agent must be refreshed repeatedly, if the penetration of moisture to the interior is to be permanently avoided. In addition, the drying agent is hard to manipulate and must be kept in a closed container and prevented from trickling out.

SUMMARY OF THE INVENTION

The lighting device according to the invention having the characteristics of the body of claim 1 has the advantage over the prior art that the entry of both water from the roadway and dirt into the interior is avoided by means of the insert that covers the vent opening; the insert is easy to manipulate and to dispose on the lighting device.

In the dependent claims, advantageous features and refinements of the lighting device of the invention are disclosed. By means of the embodiment of FIG. 2, the water-repellent property of the insert is attained in a simple way. By means of the refinement of claim 7, the penetration of water from the roadway into the interior through the insert is made still more difficult. The embodiment of claim 9 enables a simple disposition of the insert. The embodiment of claim 12 prevents water from being able to collect on the insert and penetrate into the interior. The embodiment of claim 13 makes an effective flow through the interior possible. By the refinement of claim 15, it is attained that when the vehicle is in motion, a pressure difference between the vent openings and hence a reinforced flow through the interior are brought about.

BRIEF DESCRIPTION OF THE DRAWINGS

Two exemplary embodiments of the invention are shown in the drawing and described in further detail in the ensuing description.

DESCRIPTION OF THE EXEMPLARY EMBODIMENTS

Figure 1:
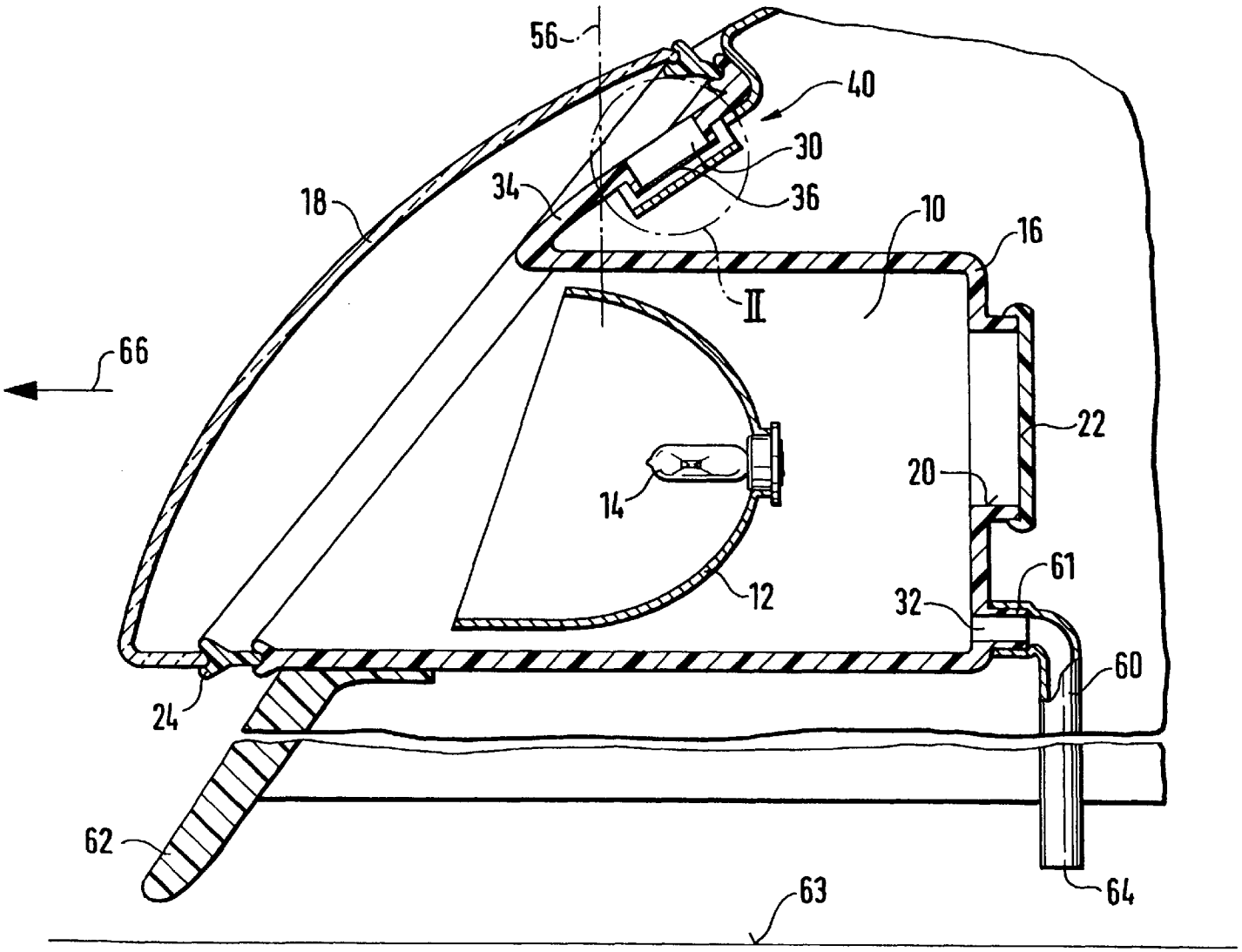
FIG. 1 shows a lighting device in vertical longitudinal section.

A lighting device shown in FIGS. 1–5 for vehicles, especially motor vehicles, is embodied in particular as a headlight or headlight unit and is intended to be mounted on the vehicle in the known manner. The lighting device has a sealed interior 10, in which at least one reflector 12 and at least one light source 14 are disposed. The interior 10 is defined at least in part by a housing 16 and by a glass or plastic transparent or translucent disk 18 that closes off the light exit opening of the housing. The housing 16 may have an opening 20 on its back side, through which the at least one light source 14 is accessible and which can be closed by means of a detachable cap 22, by which the interior 10 is then correspondingly jointly defined. The disk 18 may be joined to the housing 16 via an intermediate frame 24, in which case the interior 10 is also jointly defined by the intermediate frame 24. The housing 16 and the intermediate frame 24 are preferably of plastic and are made by injection molding. The intermediate frame 24 can be embodied such that an existing gap between the reflector 12 and the housing 16 is at least partly covered by it.

Figure 4:
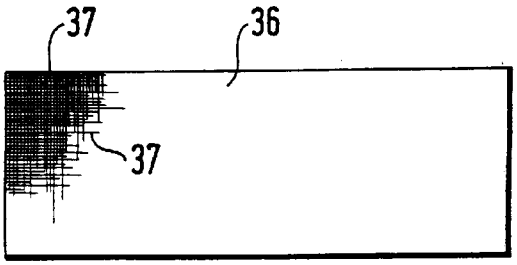
FIG. 4 shows an insert that covers a vent opening in an elevation view in the direction of the arrow IV of FIG. 2 in accordance with a first exemplary embodiment.

The housing 16 has at least one vent opening 30, through which the interior 10 communicates with the environment. In the exemplary embodiments shown, the housing 16 has two vent openings; in the installed position of the lighting device in the vehicle, one vent opening 30 is disposed in an upper region of the housing 16, and the other vent opening 32 is disposed in a lower region of the housing 16. The vent opening 30 is embodied in a wall 34 of the housing 16 and is preferably disposed near the disk 18 that closes the light exit opening. In cross section, the vent opening 30 is approximately rectangular, as shown in FIG. 4, but it can also have any arbitrary other cross-sectional shape. The vent opening 30 is covered with a matlike insert 36, which is embodied to be air-permeable and water-repellent.

In a first exemplary embodiment, shown in FIG. 4, the insert 36 comprises a woven fabric, whose individual fibers 37 are woven together in meshlike form. By way of example, the fibers 37 may be plastic fibers, comprising polyester or some other plastic. The insert 36 has a thickness ranging for instance from approximately 0.1 mm to several millimeters, in particular a thickness of approximately 0.5 mm. The density and fineness of the pores of the insert 36 are determined such that on the one hand, the insert 36 has adequate filtering action to prevent or at least reduce the entry of dirt and dust into the interior 10, and that on the other, the insert 36 has sufficient air permeability for ventilating the interior 10. To attain the water-repellent property of the insert 36, its fibers 37 may for instance be impregnated to be water-repellent.

Figure 2:
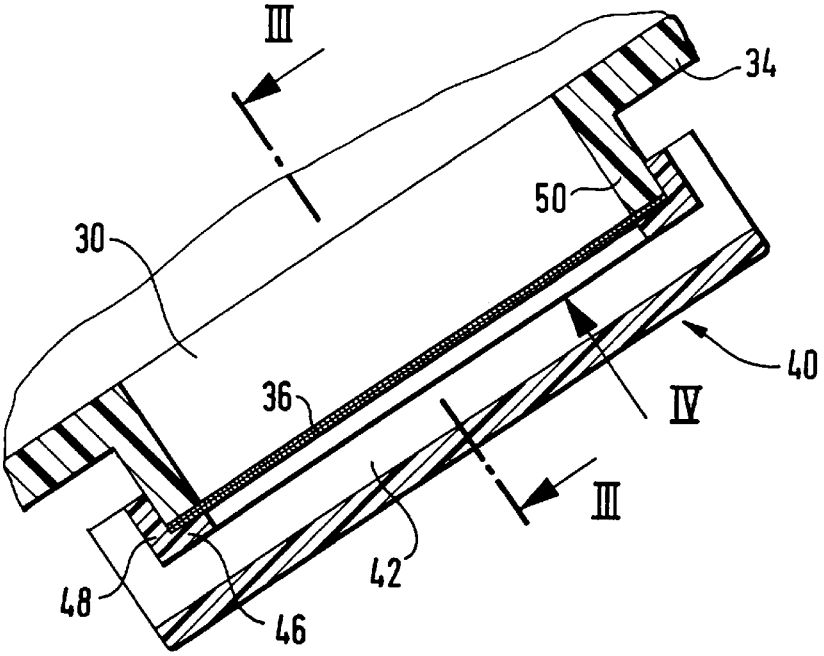
FIG. 2 shows the detail marked II in FIG. 1 of the lighting device on a larger scale.
Figure 3:
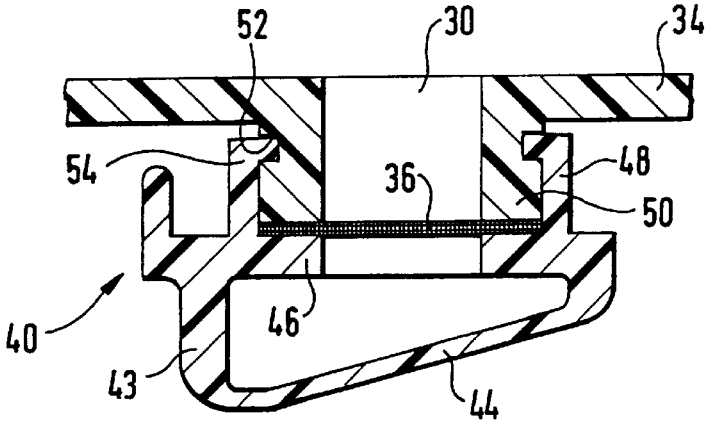
FIG. 3 shows a portion of the lighting device in a cross section taken along the line III—III of FIG. 2.

To protect the insert 36 against splashing water, it is at least partly covered by a shielding device 40. In the exemplary embodiments, the shielding device 40 is embodied such that it has a channel-like portion 42, covering the insert 36, that protrudes laterally past the insert on both sides. In cross section, the portion 42 is approximately triangular, for instance, as shown in FIG. 3, and has a side wall 43, which is disposed laterally beside and approximately perpendicular to the insert 36 and has a cover wall 44 inclined relative to the insert 36. The portion 42 may also have some other cross-sectional shape, such as rectangular or trapezoidal. On its two shorter sides, the portion 42 is open, resulting in its channel-like shape. The shielding device 40 can be secured to the wall 34 of the housing 16 and, as shown in FIGS. 2 and 3, has a frame 46 extending all the way around that protrudes inward toward the wall 34 from the side wall 43 or cover wall 44. The insert 36 is placed on the frame 46 from the side of the shielding device 40 toward the housing 16. In order to be fixed to the frame 46, the insert 36 can be glued on; to that end, the insert 36 or the frame 46 may be embodied as self-adhesive by means of an appropriate coating or adhesive tape. However, adhesive can also be applied separately. Alternatively, the insert 36 can also be clamped in place for fixation by means of an edge 48 of the shielding device 40 surrounding the frame 46. In that case, the insert 36 together with the shielding device 40 forms a preassembled structural unit that is secured to the housing 16. The shielding device 40 is preferably of plastic and is made by injection molding.

The securing of the shielding device 40 to the wall 34 can be done by way of example, as shown in FIG. 3, by means of a detent connection. For instance, a collar 50 surrounding the vent opening 30 can protrude outward from the wall 34 of the housing 16, and a plurality of indentations 52, or a single encompassing indentation, is embodied in its outer circumference. The shielding device 40 may have a plurality of detent hooks 54, distributed over its circumference, which are disposed surrounding the collar 50 and can interlock with corresponding detent protrusions in the indentations 52. The insert 36, in the final position of the shielding device 40 on the housing 16, is fastened in place between the face end of the collar 50 and the frame 46. Alternatively, the shielding device 40 can be secured to the wall 34 in some other way, for instance by adhesive bonding or screwing.

Figure 5:
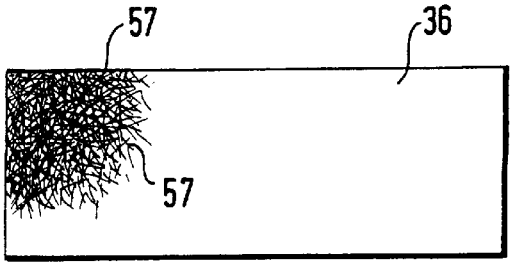
FIG. 5 shows the insert in the elevation view in the direction of the arrow IV in accordance with a second exemplary embodiment.

The wall 34 of the housing 16 in which the vent opening 30 is embodied is preferably disposed, as shown in FIG. 1, in such a way that in the installed position of the lighting device in the vehicle, it points with its outside downward. The wall 34 is then inclined relative to a vertical 56 and points downward with its outside. The result attained by this is that no water can strike the insert 36, which covers the vent opening 30, from above and collect on it but instead runs downward and drips off. Water running down from the top of the lighting device, because of the disposition of the lighting device on the downward-pointing wall 34, does not flow across the insert 36 but rather drips off from the edge located between the top of the lighting device and the wall 34. The shielding device 40 is disposed such that its open face ends protrude upward and downward, resulting in a continuous channel that follows the inclination of the wall 34. Any water penetrating into the shielding device 40 then runs off through the channel formed by the side walls 43 and the cover wall 44, without reaching the insert 36. In FIG. 5, the insert 36 is shown in a second exemplary embodiment, in which unlike the first exemplary embodiment the insert comprises nonwoven fabric. The fibers 57 are not woven together in an oriented way but rather are worked or pressed together in random orientation. The insert 36 preferably comprises polyester fibers impregnated to be water-repellent. The thickness of the insert 36 may range between approximately 0.1 mm and several millimeters, and its density and the fineness of its pores are determined such that both adequate filtering action and adequate air permeability exists. The remainder of the embodiment of the shielding device 40 and of the lighting device is unchanged from the first exemplary embodiment.

Communicating with the lower vent opening 32 of the housing 16, as shown in FIG. 1, is a line 60, which may be embodied as either a flexible hose and a rigid tube and which preferably discharges on the underside of the vehicle near the roadway. The lower vent opening 32 may for instance be disposed in the bottom of the housing 16 or in the rear wall of the housing near the bottom. The line 60 may be slipped onto an outward-protruding connection piece 61 surrounding the vent opening 32, or may be inserted with a connection piece into the vent opening 32. In the exemplary embodiment shown, the vehicle has a spoiler 62 on its front end, and the line 60 discharges at a somewhat greater distance above the roadway 63 from the spoiler 32, and its mouth 64 is disposed offset from the spoiler 62 in the opposite direction from the travel direction 66 of the vehicle. The lower vent opening 32 and the line 60 communicating with it have a smaller cross section than the upper vent opening 30 and the insert 36 covering it. When the vehicle is in motion, a flow through the interior 10 of the lighting device takes place, because there is less resultant pressure from wind resistance at the mouth 64 of the line than at the upper vent opening 30, so that air flows out through the lower vent opening 32 and in through the upper vent opening. This prevents water or dirt from penetrating the interior 10 through the insert 36. The larger cross section of the upper vent opening 30, compared with the cross section of the lower vent opening 32, leads to reduced flow speeds for the inflowing air, so that only slight amounts of dirt can enter the insert 36 and there is only a slight pressure loss. Because the upper vent opening 30 is disposed near the disk 18, any moisture precipitating onto the disk can be quickly and effectively removed, when the vehicle is in motion, by the air flowing along the disk 18. When the vehicle is at a stop, ventilation of the interior 10 from bottom to top takes place, since at the bottom of the vehicle cool air with low humidity enters the line 60 and the lower vent opening 32, and warmer air exits through the upper vent opening 30. Moisture from the interior 10 can be removed along with the emerging air through the insert 36.

In a departure from the above-explained version of the lighting device, the upper vent opening 30 and/or the lower vent opening 32 may also be embodied in the disk 18, the intermediate frame 24, or the cap 22, instead of in the housing 16. It is also possible for a plurality of upper vent openings 30 and/or lower vent openings 32 to be provided.

What is claimed is:

1. A lighting device for vehicles, having a sealed interior (10) in which at least one reflector (12) and at least one light source (14) are disposed and which communicates with the environment via at least one vent opening (30), characterized in that said at least one vent opening (30) is covered by a mat-like, air permeable and water-repellant insert (36) and is disposed in an upper region of the lighting device in an installed position of the lighting device in the vehicle, wherein at least one further vent opening (32) is formed in the lighting device which, in the installed position of the lighting device in the vehicle is disposed in a lower region of the lighting device, and wherein the cross-section of said at least one vent opening (30) disposed in the upper region is larger than the cross-section of said at least one further vent opening (32) disposed in the lower region so that when the vehicle is in motion airflows into said interior through said at least one vent opening (30) and exits said interior through said at least one further vent opening (32) thus reducing air flow speed of an inflowing air and substantially reducing amounts of dirt and water penetrating said interior through said insert.

2. The lighting device of claim 1, characterized in that the insert (36) is impregnated to be water-repellent.

3. The lighting device of claim 1, characterized in that the insert (36) is embodied as woven fabric.

4. The lighting device of claim 1, characterized in that the insert (36) is embodied as nonwoven fabric.

5. The lighting device of claim 3, characterized in that the insert (36) comprises plastic fibers.

6. The lighting device of claim 5, characterized in that the insert (36) comprises polyester fibers.

7. The lighting device of claim 1, characterized in that the insert (36) is protected against splashing water by a shielding device (40).

8. The lighting device of claim 7, characterized in that the shielding device (40) at least partly covers the insert (36) and has a conduit-like portion (42), the portion (42) being open on at least one face end.

9. The lighting device of claim 7, characterized in that the insert (36) can be fixed to the shielding device (40) and can be secured together with it to the lighting device.

10. The lighting device of claim 7, characterized in that the shielding device (40) can be secured to the lighting device by means of at least one detent connection (52, 54).

11. The lighting device of claim 1, characterized in that said at least one vent opening (30), in the installed position of the lighting device in the vehicle, is disposed in a wall (34) of the lighting device that points downward with its outside.

12. The lighting device of claim 1, characterized in that a line (60) that discharges at the underside of the vehicle near the roadway communicates with said at least one further vent opening (32).

* * * * *